US011180358B1

(12) United States Patent
Reyes Perez Valenzuela

(10) Patent No.: US 11,180,358 B1
(45) Date of Patent: Nov. 23, 2021

(54) PORTABLE BEVERAGE DISPENSER WITH MULTIPLE FLUID CHAMBERS

(71) Applicant: Jose Antonio Reyes Perez Valenzuela, Michoacan (MX)

(72) Inventor: Jose Antonio Reyes Perez Valenzuela, Michoacan (MX)

( * ) Notice: Subject to any disclaimer, the term of this patent is extended or adjusted under 35 U.S.C. 154(b) by 0 days.

(21) Appl. No.: 16/865,449

(22) Filed: May 4, 2020

(51) Int. Cl.
*B67D 1/00* (2006.01)
*B67D 1/08* (2006.01)
*B67D 1/04* (2006.01)

(52) U.S. Cl.
CPC ..... *B67D 1/0021* (2013.01); *B67D 1/0431* (2013.01); *B67D 1/0804* (2013.01); *B67D 1/0857* (2013.01); *B67D 2001/0091* (2013.01)

(58) Field of Classification Search
CPC .. B67D 1/0021; B67D 1/0431; B67D 1/0808; B67D 2001/0091
USPC ..... 222/130–132, 129, 129.1, 146, 6, 146.6
See application file for complete search history.

(56) References Cited

U.S. PATENT DOCUMENTS 1,096,572 A * 5/1914 Stoffel ..... F25D 3/08 220/592.18
1,658,579 A 2/1928 Henry
2,420,959 A 5/1947 Lanese
2,620,107 A 12/1952 Tolan
D171,000 S 12/1953 Levine
D192,344 S 3/1962 Hrabc
3,395,550 A 8/1968 Dungan
3,735,898 A 5/1973 Smith
4,059,181 A * 11/1977 Greenfield, Jr. ..... G07F 13/06 194/242
D271,877 S 12/1983 Hof
4,440,318 A 4/1984 Berger
D321,745 S 11/1991 Murrell
D323,513 S 1/1992 Asten
5,233,914 A 8/1993 English
5,494,193 A * 2/1996 Kirschner ..... B67D 1/0021 222/129.1

(Continued)

FOREIGN PATENT DOCUMENTS

CA 146201 S 5/2013
CN 302783857 4/2014

(Continued)

OTHER PUBLICATIONS

Bunn, "Bunn BT BT Speed Brew 10-Cup Thermal Carafe Home Coffee Brewer," Apr. 4, 2007. Amazon.com, www.amazon.com/dp/B000FFRYYK (Year:2007).

(Continued)

*Primary Examiner* — Lien M Ngo
(74) *Attorney, Agent, or Firm* — Benjamin M. Hanrahan

(57) ABSTRACT

A portable, battery-operated beverage dispenser is presented herein. The portable beverage dispenser includes a housing defining a plurality of fluid compartments each independently fluidically interconnected to a nozzle via a plurality of fluid distribution tubes. Each of the plurality of fluid compartments are further connected to a pump which selectively distributes air into the fluid compartments via corresponding tubes. Each of the different fluids disposed within each of the different fluid compartments can thus be selectively dispensed into a cup in any desired amount or combination, as desired.

18 Claims, 14 Drawing Sheets

(56) References Cited

U.S. PATENT DOCUMENTS

| | | | | |
|---|---|---|---|---|
| 5,890,629 | A * | 4/1999 | Loew | B67D 3/0035 222/144.5 |
| D412,177 | S | 7/1999 | Fujii | |
| 6,364,329 | B1 | 4/2002 | Holub et al. | |
| D488,670 | S | 4/2004 | Chan | |
| D552,402 | S | 10/2007 | Schwamkrug | |
| 7,565,860 | B1 | 7/2009 | Liu | |
| D624,780 | S | 10/2010 | Bodum | |
| 8,028,866 | B2 | 10/2011 | Martin | |
| 8,104,642 | B2 | 1/2012 | Bambrick et al. | |
| D656,578 | S | 3/2012 | Sherman et al. | |
| 8,393,493 | B1 * | 3/2013 | Christensen | A47J 43/07 220/592.18 |
| D708,749 | S | 7/2014 | Appling et al. | |
| D742,679 | S | 11/2015 | Bartoli et al. | |
| 9,199,782 | B1 | 12/2015 | Cliatt | |
| 9,289,734 | B2 * | 3/2016 | Solera | B05B 15/52 |
| 9,314,561 | B2 | 4/2016 | Appling et al. | |
| D760,530 | S | 7/2016 | Bartoli et al. | |
| 9,475,683 | B2 | 10/2016 | Givens et al. | |
| 9,695,030 | B2 | 7/2017 | Walker | |
| 10,005,657 | B2 | 6/2018 | Lim et al. | |
| D824,196 | S | 7/2018 | Shin et al. | |
| 10,167,184 | B1 | 1/2019 | Samples | |
| D843,767 | S | 3/2019 | Shin et al. | |
| 10,233,003 | B2 | 3/2019 | DeRaedt et al. | |
| D860,387 | S | 9/2019 | Iyasu et al. | |
| D909,433 | S | 2/2021 | Lee et al. | |
| 2003/0146241 | A1 * | 8/2003 | Moothart | B67D 3/0009 222/130 |
| 2008/0093384 | A1 * | 4/2008 | Fire | B67D 1/0412 222/144.5 |
| 2009/0120961 | A1 | 5/2009 | Dietschi et al. | |
| 2014/0114469 | A1 | 4/2014 | Givens et al. | |
| 2015/0069087 | A1 * | 3/2015 | Brown | A47J 31/41 222/129.1 |
| 2016/0090288 | A1 | 3/2016 | Givens, Jr. et al. | |
| 2016/0130127 | A1 | 5/2016 | Copenhaver et al. | |
| 2016/0255990 | A1 | 9/2016 | Bartoli et al. | |
| 2017/0101301 | A1 | 4/2017 | Volin | |
| 2017/0320718 | A1 | 11/2017 | Sherman et al. | |
| 2018/0044621 | A1 | 2/2018 | Smart et al. | |
| 2018/0194607 | A1 | 7/2018 | Diffenderfer | |
| 2018/0371385 | A1 | 12/2018 | Hong et al. | |
| 2019/0062138 | A1 | 2/2019 | Elmery | |
| 2021/0024341 | A1 * | 1/2021 | Christiansen | B67D 1/1225 |
| 2021/0131724 | A1 | 5/2021 | Lee et al. | |

FOREIGN PATENT DOCUMENTS

| | | |
|---|---|---|
| CN | 305098922 | 4/2019 |
| CN | 305692703 | 4/2020 |
| EM | 008240345-0001 | 11/2020 |
| GB | 90065420980001 | 5/2019 |
| KR | 3004072160002 | 12/2009 |
| WO | D097704020 | 10/2017 |

OTHER PUBLICATIONS

Yee, Hui, "Krups 324 Dual Carafe Coffee Machine," Jun. 25, 2015, OnCoffeeMakers.com, www.oncoffeemakers.com/krups-324-dual-carafe-coffee-machine.html (Year:2015).

Pomranz, Mike, "LG's Beer Machine Actually Brews—But to What End?" Dec. 11, 2018, Food & Wine, www.foodandwine.com/beer/lg-homebrewing-beer-machine (Year:2018).

Metro Decor, "mDesign Plastic Bathroom Vanity Countertop Canister Jar with Storage Lid," Jun. 13, 2018, Amazon.ca, www.amazon .calm Design-Bathroom-Countertop-Canister-Recessed/dp/B07CS32WMX (Year: 2018).

River Colony Trading, "CucinaPro Double Coffee Brewer Station," Nov. 27, 2018, Amazon.com, www.amazon.com/dp/B07KX7FZ7L (Year:2018).

Bonetto, Adrien, "Du rhum en capsule? Le Rhum est mort, vive le Rhum!" Apr. 19, 2019, Rumporter.com, https://rumporter.com/du-rhum-en-capsule-le-rhum-est-mort-vive-le-rhum/(Year: 2019).

* cited by examiner

PORTABLE BEVERAGE DISPENSER WITH MULTIPLE FLUID CHAMBERS

FIELD OF THE INVENTION

The present invention is generally directed to a beverage distribution assembly, and more specifically, to a portable cocktail mixer or dispenser with multiple beverage chambers.

BACKGROUND OF THE INVENTION

It is common for individuals at social or non-social gatherings or events to consume various beverages, including alcoholic beverages, such as mixed cocktails or beer, and non-alcoholic beverages, such as soda, juice, and water. In particular, individuals often bring alcoholic and non-alcoholic beverages to the beach, pool, tailgating events, concerts, etc. These beverages are often carried in a cooler filled with ice to keep the beverages cool until they are consumed.

When the beverages are premixed or prepackaged in a single container, such as beer in a bottle or can, an individual will simply grab the bottle or can from the cooler and consume the beverage. A problem arises, however, when the individual(s) desire mixed drinks and particularly drinks that are not premixed, such as, but not limited to alcoholic cocktails. In such a case, the individual may place one or more liquor bottles and one or more mixers (e.g., soda, juice, etc.) into the cooler. When the individual desires to consume a mixed drink, he or she will then pour the beverage by pouring an amount of fluid from the one or more liquor bottles and an amount of fluid from one or more mixers until the desired beverage is made.

This, however, requires a number of separate bottles, cans and other containers to be carried around, e.g., within the cooler. It can also be problematic in that when the bottles, cans or other containers holding the liquor, mixers, or other beverages is emptied, there is a likelihood that the individual will leave the empty container(s) at the location, creating undesirable litter.

There is thus a need in the art for a portable beverage and/or cocktail mixer/dispenser that is capable of separately holding a plurality of different beverages or fluids, whether alcoholic or non-alcoholic, and which can be used virtually anywhere. The proposed dispenser would preferably be battery-operated, refillable, reusable, and, in some cases, capable of being operated without the need for additional gas canisters or sources, such as CO2 canisters. In this manner, the proposed dispenser can reduce littering, control the cleanliness of the cocktail being dispensed, and allow for a plurality of different beverages to be used, as chosen by the user.

In addition, it would be advantageous if the proposed beverage dispenser includes one or more ice compartments that can be positioned to keep the beverages cool such that an additional cooler is not needed to enjoy a plurality of different alcoholic and non-alcoholic beverages at any location and time.

SUMMARY OF THE INVENTION

Accordingly, as disclosed herein, the present invention is generally directed to a portable and battery-operated beverage dispenser with a plurality of separately partitioned fluid or beverage compartments.

In particular, the beverage dispenser of at least one embodiment includes a housing defining the plurality of fluid compartments and at least one component enclosure. Each of the fluid compartments are configured to separately retain a beverage therein for selective distribution or dispensing there from. In some embodiments the housing may represent, at least generally, a figure eight shape with a two cylindrical chambers separated in the center by the component enclosure.

Each of the two cylindrical chambers may include an inner cylindrical ice compartment surrounded by a plurality of partitioned fluid compartments. In some cases, the fluid compartments may collectively include four two liter compartments and two seven hundred and fifty milliliter compartments, although other sizes, dimensions and capacities are contemplated.

Moreover, each of the fluid compartments are fluidically interconnected to at least one discharge nozzle via a fluid discharge assembly. In particular, the fluid discharge assembly is structured to facilitate the dispensing of fluid from one or more of the plurality of fluid compartments in response to a user's selection. For instance, the fluid discharge assembly may include a plurality of air pumps and a plurality of fluid discharge tubes, wherein each of the plurality of fluid compartments are connected to a different one of the plurality of air pumps and each of the plurality of fluid compartments are fluidically interconnected to the discharge nozzle(s) via a different one of the plurality of fluid discharge tubes.

In this manner, the user can select a particular fluid compartment (and corresponding fluid) by pressing a button, for example, that corresponds to the selected fluid compartment. Doing so will activate the corresponding air pump, thereby pressurizing the corresponding fluid compartment. This will, in turn, cause the fluid to flow through the fluid discharge tube to the nozzle, where the fluid or beverage will then be dispensed into the user's cup sitting on the support ledge underneath the nozzle. In some embodiments, the fluid will continue to flow as the user holds the button, allowing the user to dispense as much or as little of the fluid as desired. In other embodiments, a predetermined amount of fluid will be dispensed for each push of the button.

It should also be noted that some embodiments of the present invention may also include one or more storage compartments, for example, disposed below the one or more fluid chambers, although other locations are contemplated. In some embodiments, the storage compartment(s) will share a common wall with or otherwise be proximate to the ice compartment(s). This can, therefore, maintain a cool or reduced temperature within the storage compartments where cans or bottles of beer or soda can be stored. Other items such as cups, bottle openers, tooth picks, olives, etc. can also be stored in the one or more storage compartments. In any event, the one or more storage compartments may also each have a door attached thereto via a hinge, and in some cases, a retention device such as one or more magnets, clips, snaps, etc. that function to keep the door(s) in the close position until otherwise opened by a user.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 10:
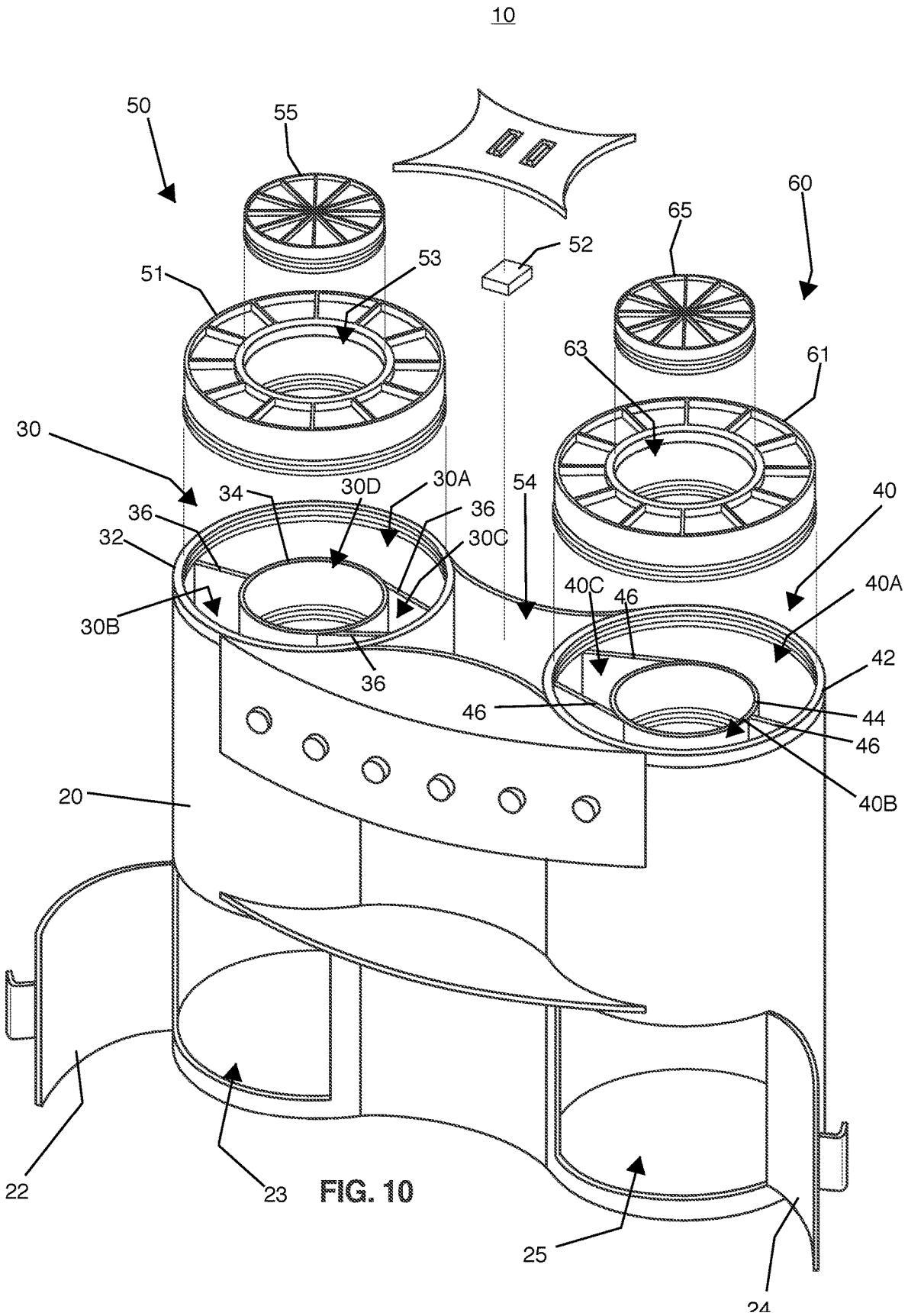
FIG. 10 is an exploded view of the beverage dispensed illustrated in FIGS. 1 through 9.

As shown in the accompanying drawings, and with initial reference to FIGS. 1 through 9, the present invention is generally directed to a beverage distribution assembly, referenced as 10. In some embodiments, the assembly 10 is portable and operable to prepare beverages, including but not limited to mixed beverages, cocktails, alcoholic beverages, non-alcoholic beverages, etc. in virtually any location and particularly in locations where preparing beverages may be difficult or complicated, such as, for example, at the beach or pool, concert, outdoor activities, picnic, beach clubs, festival, public hall, at home, bars, at a sporting event or tailgate, at camp grounds, etc. In this manner, some embodiments of the beverage distribution or dispensing assembly 10 of the present invention includes one or more rechargeable batteries 52, as shown in FIG. 10, that is capable of powering the various components, as described herein, without the need for an additional power source.

Figure 2:
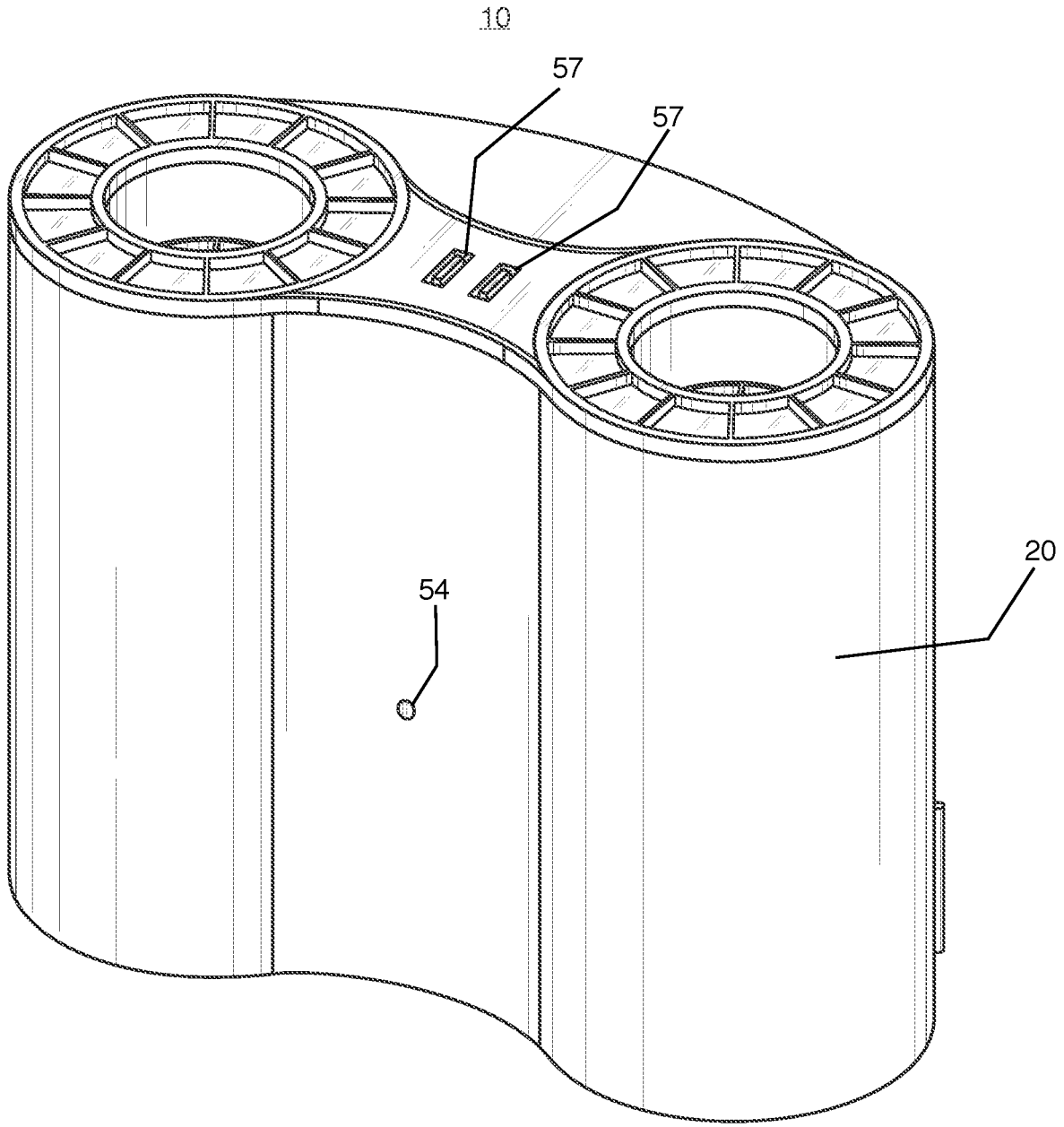
FIG. 2 is a rear perspective view of the beverage dispenser illustrated in FIG. 1.
Figure 3:
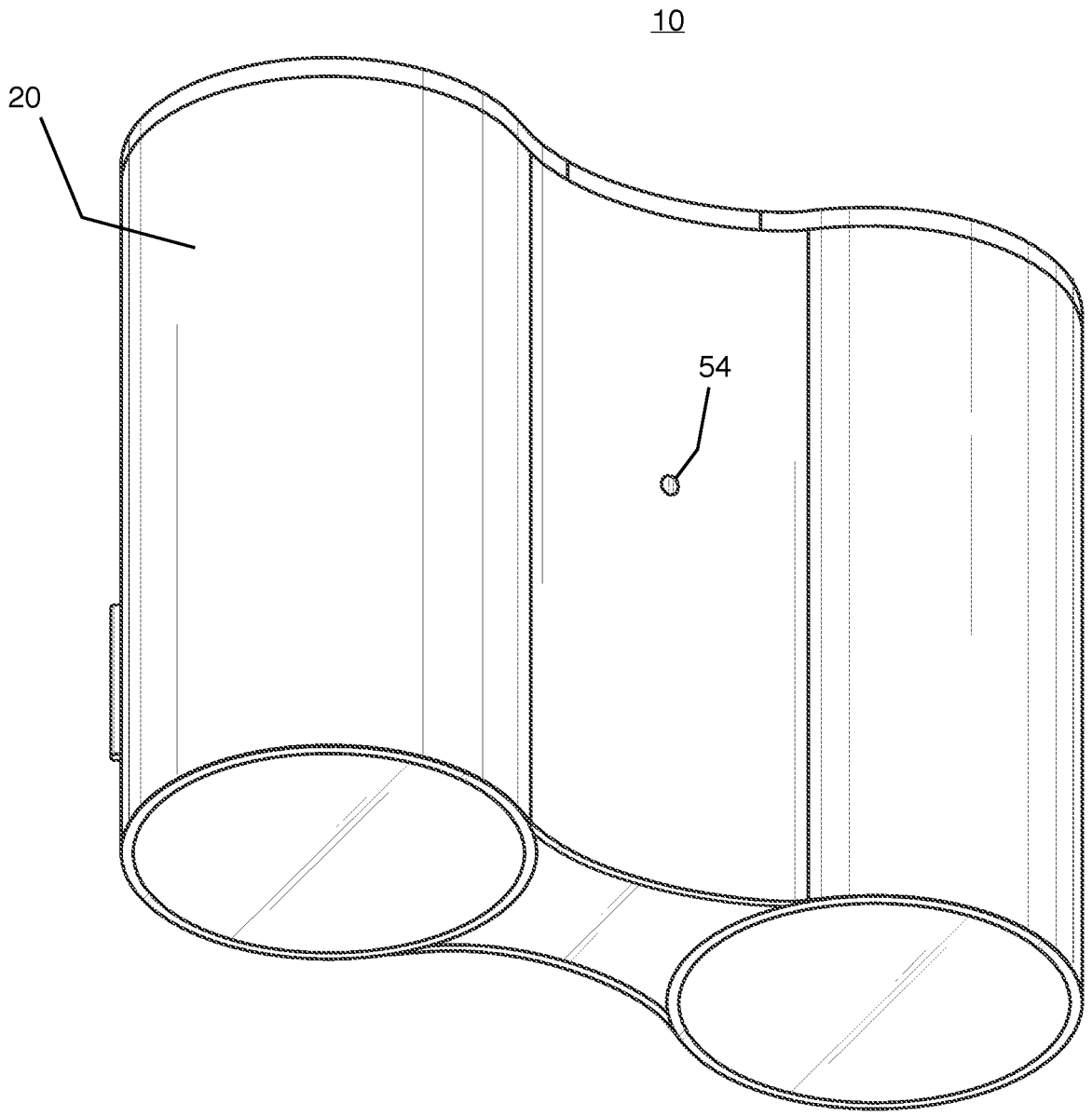
FIG. 3 is a bottom perspective view of the beverage dispenser illustrated in FIGS. 1 through 2.
Figure 4:
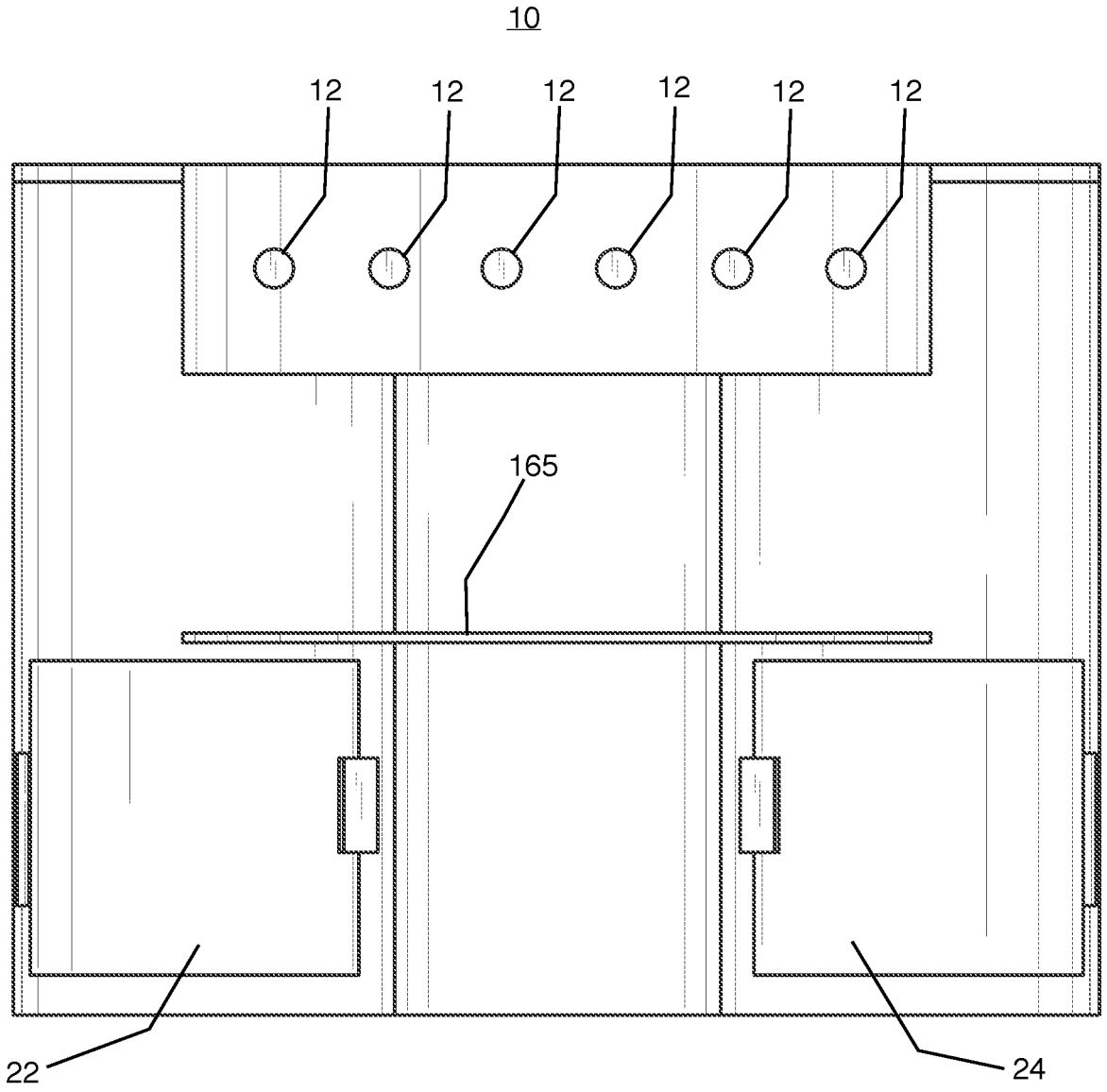
FIG. 4 is a front view of the beverage dispenser illustrated in FIGS. 1 through 3.
Figure 5:
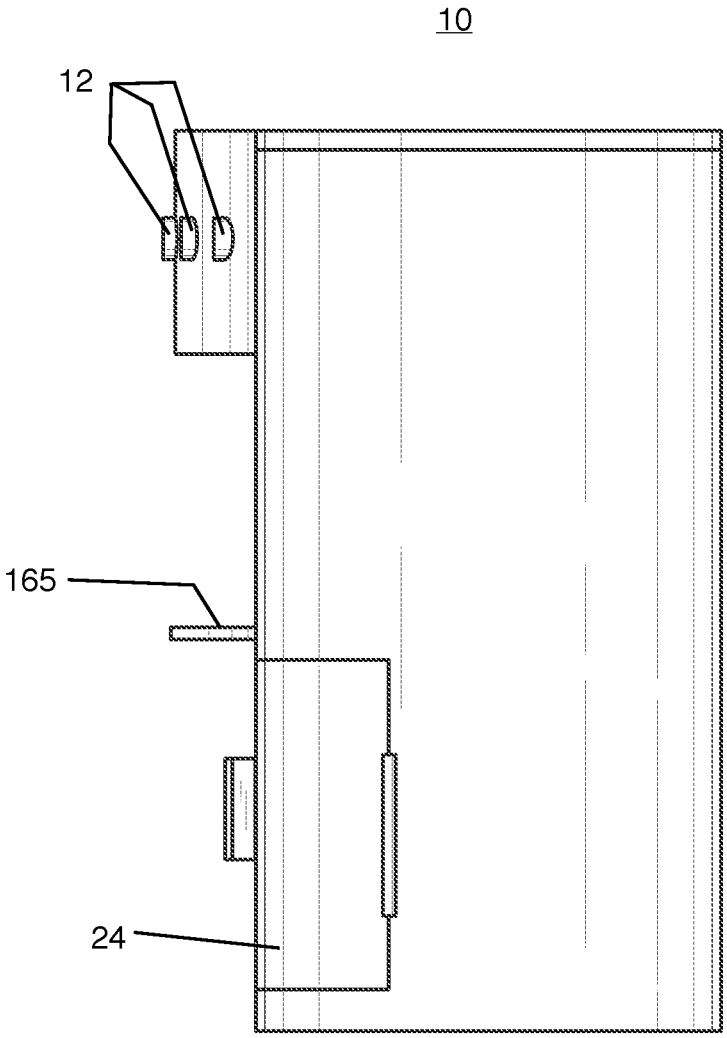
FIG. 5 is a right side view of the beverage dispenser illustrated in FIGS. 1 through 4.
Figure 6:
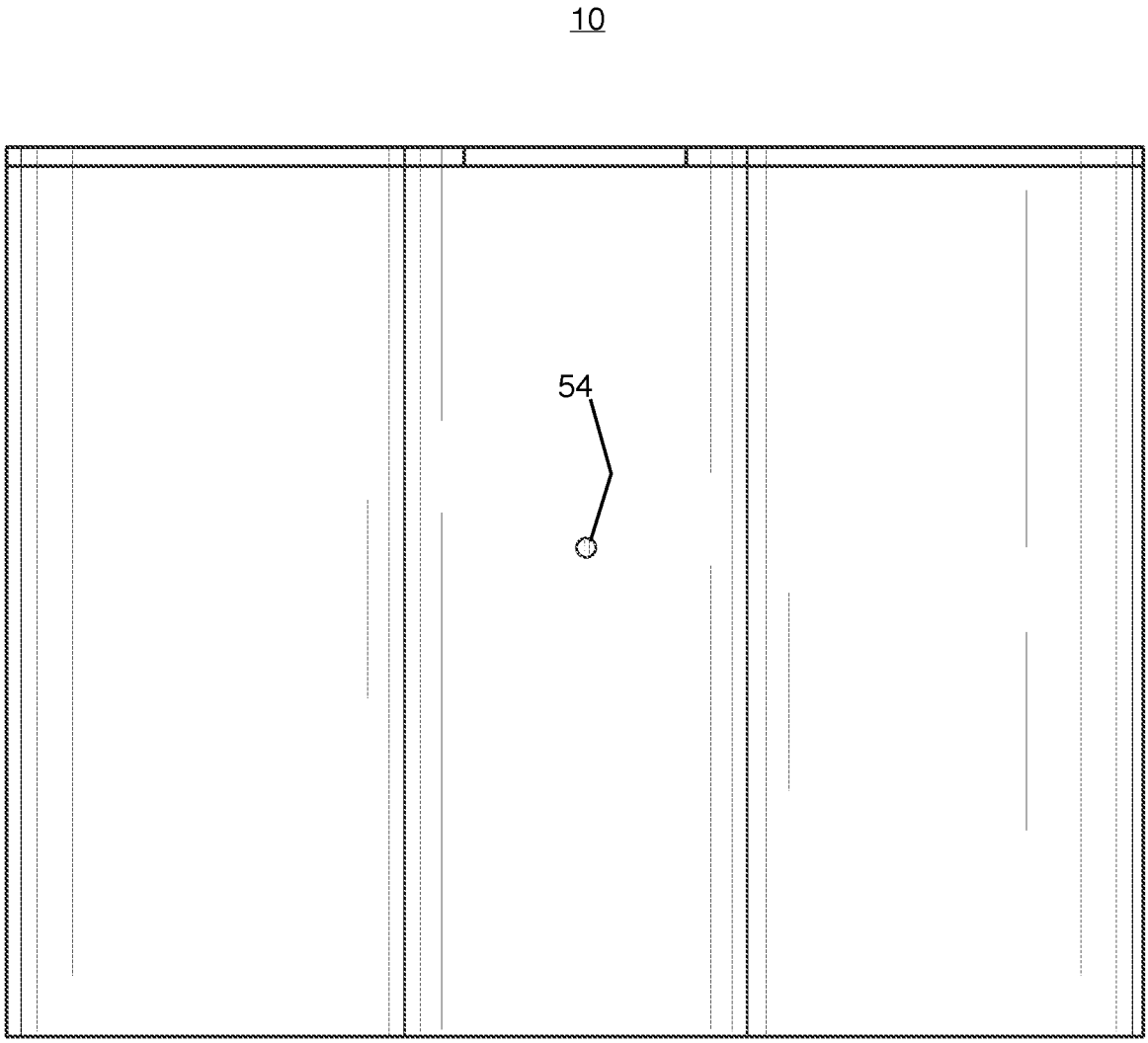
FIG. 6 is a rear view of the beverage dispenser illustrated in FIGS. 1 through 5.
Figure 7:
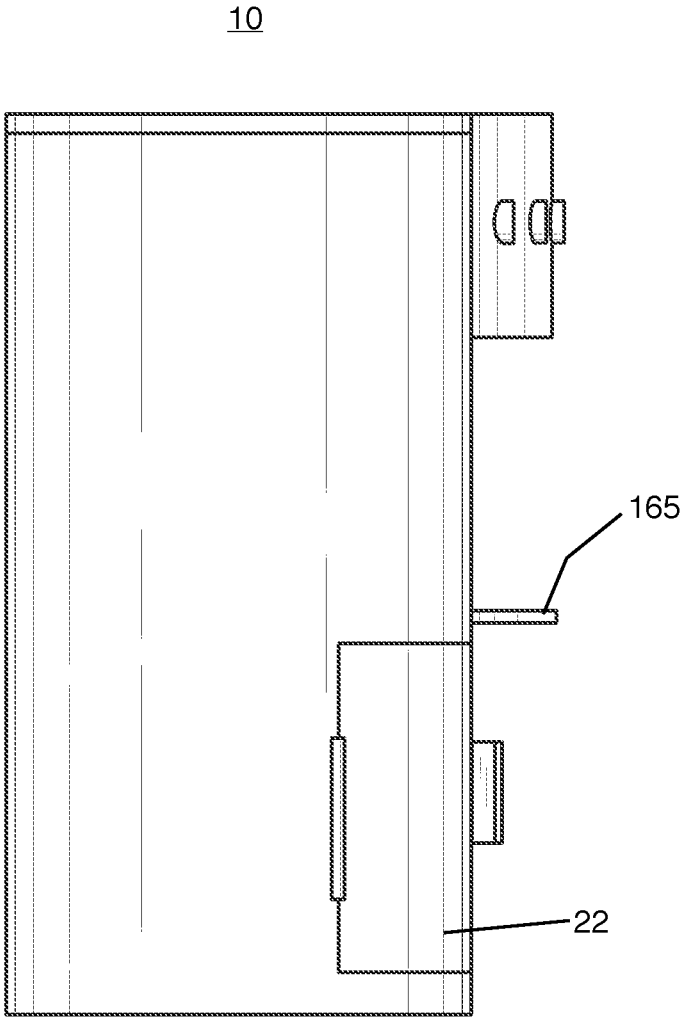
FIG. 7 is a left side view of the beverage dispenser illustrated in FIGS. 1 through 6.
Figure 8:
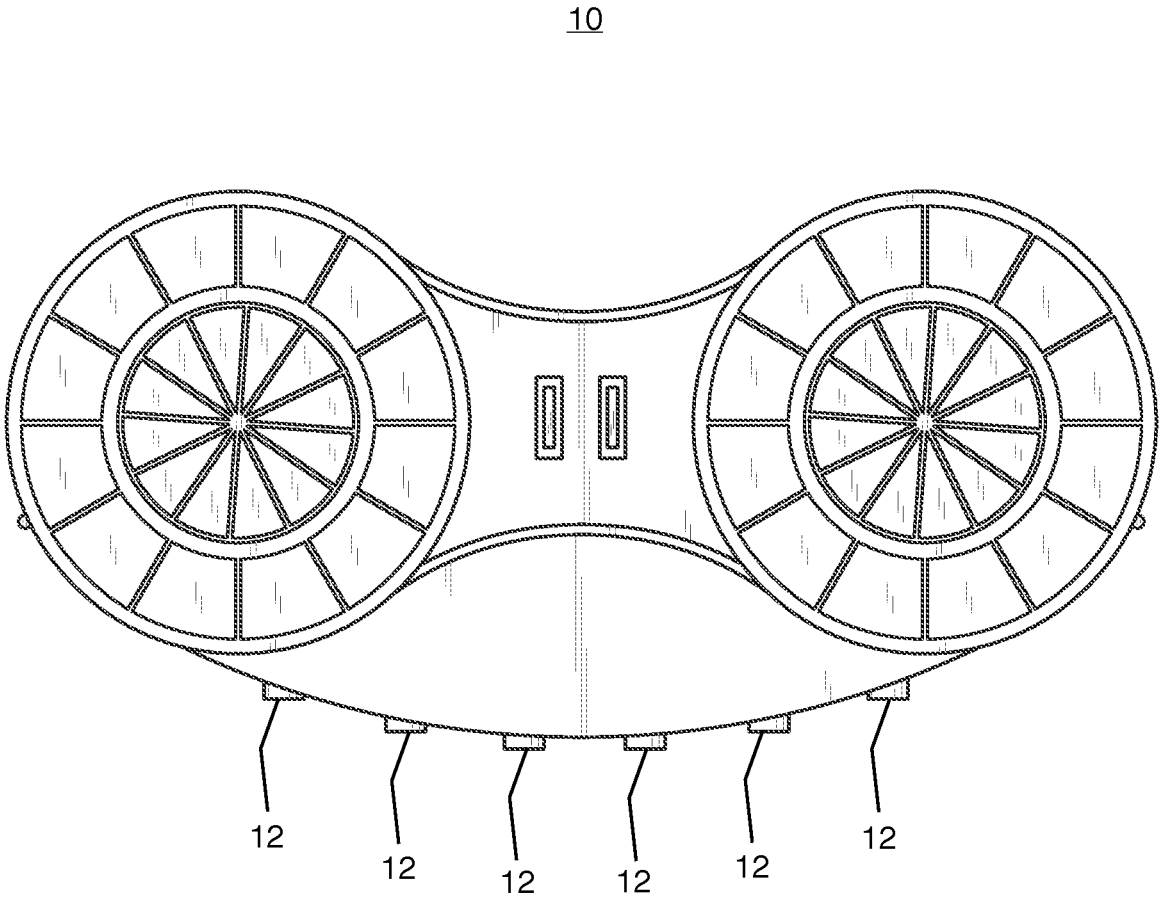
FIG. 8 is a top view of the beverage dispenser illustrated in FIGS. 1 through 7.
Figure 9:
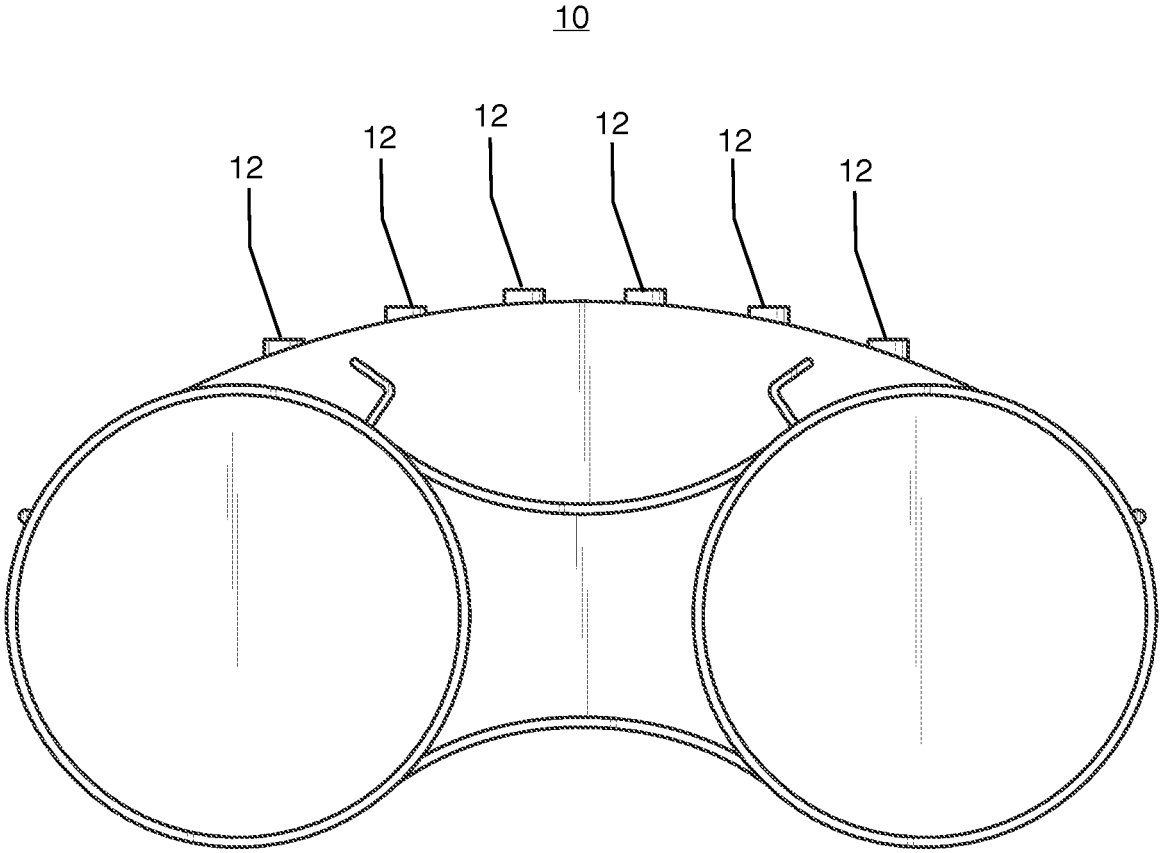
FIG. 9 is a bottom view of the beverage dispenser illustrated in FIGS. 1 through 8.

For instance, in at least one embodiment, the battery 52 may be a 15000 milliamp Hour (mAh) Lithium-ion battery, although other sizes and capacities are contemplated within the various embodiments of the present invention. Furthermore, the battery 52 may be electrically interconnected to a charging port 54, which in some cases, may be disposed or accessible somewhere on the housing 20, for example, on the rear portion (as shown in FIG. 2, for example), or on a side, bottom, front or top portion. A cable (not shown) can be used to charge the battery 52 by connecting the cable to the charging port 54 and an external power source. In some embodiments, one or more auxiliary connection ports 57, such as, but not limited one or more universal serial bus (USB) ports may be electrically interconnected to the one or more batteries 52 in a manner such that the one or more batteries 52 may provide power to the auxiliary connection ports 57. Accordingly, using a cable interconnected to the auxiliary connection port(s) 57, additional personal or auxiliary electronic items (e.g., cellular phones, tablets, music players, portable speakers, etc.) can be charged.

Still referring to FIGS. 1 through 9, the beverage distribution or dispensing assembly 10 of at least one embodiment includes a housing 20, which, as described herein, is structured to hold or retain a plurality of different fluids in separate or partitioned fluid containers. In some embodiments, the housing 20 may be constructed of a plastic material, including a high density polyethylene material and/or melanin. For instance, interior walls may be made of melanin while other walls can be constructed of a high density polyethylene with a thermal insulator sheet.

A plurality of buttons or activators 12 are accessible on the housing 20 such that each of the plurality of activators 12 is associated with a different one of the plurality of fluid compartments. In this manner, activation of one of the buttons or activators 12 will activate a distribution assembly (e.g., a pump, valve, nozzle, etc.) as described herein, which will cause the fluid from the corresponding fluid compartment to flow into a cup or other like vessel. In some embodiments, selectively holding the button or activator 12 down will cause the assembly 10 to continuously dispense fluid from the corresponding fluid compartment until the button or activator 12 is released. In other embodiments, a predetermined or preset amount of fluid will dispense with each activation. It should also be noted that the activator(s) 12 may take on different forms or structures in that the activator(s) 12 may be separate physical buttons, as shown in FIGS. 1-9, although it is contemplated that a touch screen or other electronic selection apparatus may be included in place of or in addition to the one or more activators 12. The touch screen may include a menu or other selectable portions which an operator can use to select a beverage or fluid to dispense.

Figure 1:
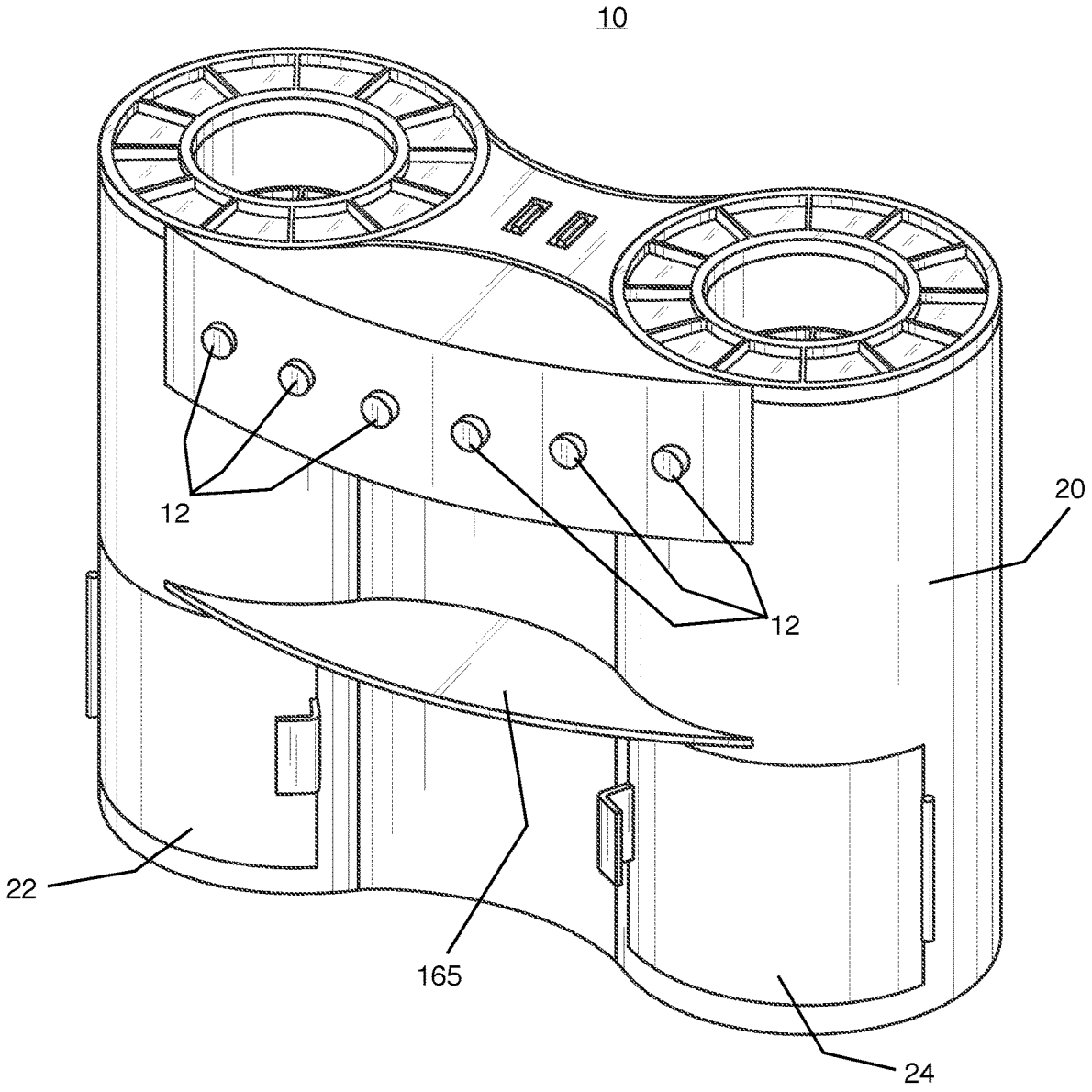
FIG. 1 is a front perspective view of the beverage dispenser as disclosed in accordance with at least one embodiment of the present invention.

Furthermore, in at least one embodiment, the housing 20 includes one or more hollow storage compartments accessible through doors 22, 24. Various items can be stored in each of the storage compartments as desired by the user or operator of the assembly 10, including, but in no way limited to beverage cans, such as beer cans or bottles, soda cans or bottles, energy drinks, juice boxes, straws, bottle openers, napkins, towels, or other beverages, food, or accessories, etc. The doors 22, 24 of at least one embodiment may include a hinge mechanism at one end and a handle at the other, allowing the doors to pivot open and closed. Additional features may include a closure mechanism structured to maintain the doors in a closed orientations (as shown in FIG. 1, for example), until a user desires to open the door(s). In some cases, the closure mechanism(s) may include corresponding magnets—one built into the door and another corresponding magnet built into the housing such that the magnets will magnetically maintain the door in the closed position until a separation force causes the doors to open. Other embodiments may include snaps, clips, locks, hooks, VELCRO, etc.

In some embodiments, the storage compartments may be approximately 19 centimeters×24 centimeters×24 centimeters and may have the capacity to store approximately thirteen twelve ounce cans, although other sizes and dimensions are contemplated within the full spirit and scope of the present invention.

With reference now to the exploded view of FIG. 10, the housing 20 of at least one embodiment includes a first chamber 30 and a second chamber 40 separated by a component enclosure 54. It should be noted that other configurations and layouts are possible with other embodiments in that one chamber or more than two chambers may be contemplated, and wherein the component enclosure(s) 54 is/are disposed elsewhere within the housing 20.

In any event, the housing 20, and in particular, the first and second chambers 30, 40, define a plurality of partitioned or separate fluid compartments, referenced as 30A-C and 40A-C. More specifically, in at least one embodiment, the first chamber 30 defines a first set of three fluid compartments 30A, 30B, 30C and the second chamber 40 defines a second set of three fluid chambers 40A, 40B, 40C. For example, each of the different fluid chambers 30A-C, 40A-C are able to separately hold or retain an amount of fluid (such as a beverage or alcohol) which can be independently dispensed through the dispensing assembly 10, as described herein.

Still referring to FIG. 10, in at least one embodiment, the first chamber 30 includes an outer wall or outer wall assembly 32, an inner wall or inner wall assembly 34 and a plurality of partition walls 36. For example, it should be noted that outer wall 32, inner wall 34 and/or partition wall(s) 36 may in some cases be a single wall, although in other cases, the walls may include a multi-wall or double-wall construction which may also include insulating space or material disposed between the wall layers.

As shown in the exemplary embodiment, the outer wall 32 may include a cylindrical configuration or shape with a corresponding concentrically disposed cylindrical inner wall 34. Of course, other shapes are contemplated within the full spirit and scope of the present invention. Furthermore, the inner wall 34 defines an inner ice compartment 30D within which ice cubes or ice packs may be disposed.

Similarly, in at least one embodiment, the second chamber 40 of at least one embodiment includes an outer wall or outer wall assembly 42, an inner wall or inner wall assembly 44 and a plurality of partition walls 46. For example, it should be noted that outer wall 42, inner wall 44 and/or partition wall(s) 46 may in some cases be a single wall, although in other cases, the walls may include a multi-wall or double-wall construction which may also include insulating material disposed between the wall layers.

As shown in the exemplary embodiment, the outer wall 42 may include a cylindrical configuration or shape with a corresponding concentrically disposed cylindrical inner wall 44. Of course, other shapes are contemplated within the full spirit and scope of the present invention. Furthermore, the inner wall 44 defines an inner ice compartment 40D within which ice cubes or ice packs may be disposed. Each of the ice compartments 30D, 40D can in some embodiments hold approximately three kilograms of ice, although other capacities are contemplated.

It should also be noted that the inner walls 34, 44 and partition walls 36, 46 may extend from a location proximate the top end of the corresponding chamber 30, 40 to a bottom end 38, 48 to define sealed and partitioned fluid chambers 30A-C, 40A-C. The partition walls 36, 46 of at least one embodiment also extend between the corresponding inner wall 34, 44 and the corresponding outer wall 32, 42 to define the plurality of fluid compartments. In some embodiments, the fluid chambers 30, 40 terminate above corresponding storage compartments 23, 25 as shown in FIG. 10.

For instance, inner ice compartments 30D, 40D may be surrounded by or at least partially surrounded by corresponding fluid compartments 30A-C, 40A-C, respectively.

More particularly, each of the fluid compartments 30A-C of the first chamber 30 may include a portion that is directly adjacent to the corresponding inner ice compartment 30D. For instance, each of the fluid compartments 30A-C or at least one of the fluid compartments 30A-C may share a common wall with the corresponding ice compartment 30D. In this manner, when ice or cold packs are disposed within the ice compartment 30D, the fluid compartments 30A-C may receive some of the cold temperatures produced by the ice compartment 30D, or by the ice or cold pack(s) disposed therein, such that the fluid(s) disposed within the fluid compartments 30A-C may reduce in temperature or otherwise stay cold as a result of the proximity to the ice. This allows the ice or cold pack(s) to continuously cool the fluid or maintain the fluid at a cold and more desirable drinking temperature without having to put ice directly into the fluid compartment(s) 30A-C, which may otherwise water down the fluid.

Similarly, each of the fluid compartments 40A-C of the second chamber 40 may include a portion that is directly adjacent to the corresponding inner ice compartment 40D. For instance, each of the fluid compartments 40A-C or at least one of the fluid compartments 40A-C may share a common wall with the corresponding ice compartment 40D. In this manner, when ice or cold packs are disposed within the ice compartment 40D, the fluid compartments 40A-C may receive some of the cold temperatures produced by the ice compartment 40D, or by the ice or cold pack(s) disposed therein, such that the fluid(s) disposed within the fluid compartments 40A-C may reduce in temperature or otherwise stay cold as a result of the proximity to the ice. This allows the ice or cold pack(s) to continuously cool the fluid or maintain the fluid at a cold and more desirable drinking temperature without having to put ice directly into the fluid compartment(s) 40A-C, which may otherwise water down the fluid.

In an exemplary embodiment, the fluid compartments 30A-C, 40A-C collectively have the capacity for storing nine and a half liters of fluid divided into six different fluid compartments. For example, the assembly 10 of at least one embodiment may have four two liter fluid compartments (30A, 30B, 40A, 40B) and two seven hundred and fifty milliliter compartments (30C, 40C). Of course, other sizes and dimensions are contemplated within the full spirit and scope of the present invention.

Still referring to FIG. 10, at least one embodiment of the present invention further includes first and second cap assemblies 50, 60 configured to selectively enclose or cover the top end of the first and second chambers 30, 40.

For instance, the first cap assembly 50 may include an outer cap 51 and an inner cap 55. Outer cap 51 of at least one embodiment includes threaded screw components disposed on an outer circumference thereof which match with corresponding threaded screw components disposed on an inner lip of the first chamber 30. In this manner, the outer cap 51 can be selectively twisted or screwed onto and off of the first chamber 30 in order to enclose or expose the fluid compartments 30A-C thereof.

Moreover, in some embodiments, and as shown in FIG. 10, the first or outer cap 51 defines an inner hole 53 which correspondingly matches with the inner ice compartment 30D. Accordingly, the outer cap 51 can enclose the fluid compartments 30A-C while still allowing access to the inner ice compartment 30D via the inner hole 53. Accordingly, a second cap or inner cap 55 may be used to selectively enclose or cover the inner ice compartment 30D. In the exemplary embodiment shown in FIG. 10, the inner cap 55 includes threaded screw components disposed on an outer circumference thereof which match with corresponding threaded screw components disposed on the inner wall of the opening 53 of the outer cap 51. In this manner, with the outer cap 51 enclosing the fluid components 30A-C, the inner cap can be selectively removed from or secured onto the outer cap 51 in order to expose or enclose the inner ice compartment 30D.

Similarly, the second cap assembly 60 may include an outer cap 61 and an inner cap 65. Outer cap 61 of at least one embodiment includes threaded screw components disposed on an outer circumference thereof which match with corresponding threaded screw components disposed on an inner lip of the second chamber 40. In this manner, the outer cap 61 can be selectively twisted or screwed onto and off of the second chamber 40 in order to enclose or expose the fluid compartments 40A-C thereof.

Moreover, in some embodiments, and as shown in FIG. 10, the first or outer cap 61 defines an inner hole 63 which correspondingly matches with the inner ice compartment 40D. Accordingly, the outer cap 61 can enclose the fluid compartments 40A-C while still allowing access to the inner ice compartment 40D via the inner hole 63. Accordingly, a second cap or inner cap 65 may be used to selectively enclose or cover the inner ice compartment 40D. In the exemplary embodiment shown in FIG. 10, the inner cap 65 includes threaded screw components disposed on an outer circumference thereof which match with corresponding threaded screw components disposed on the inner wall of the opening 63 of the outer cap 61. In this manner, with the outer cap 61 enclosing the fluid components 40A-C, the inner cap can be selectively removed from or secured onto the outer cap 61 in order to expose or enclose the inner ice compartment 40D.

It should also be noted that other embodiments may utilize different attachment and detachment techniques other than corresponding threaded screw components to selectively open and close or detach and attach the various caps. For example, various notches, protrusions, clips, hinges, etc. can be used instead of or in addition to corresponding threaded screw components.

Furthermore, in some embodiments, the one or more caps 51, 55, 61, 65 may include one or more grips, ribs, or handles disposed thereon, for example, radially spaced about the top surface, as shown in FIG. 10. This can assist the user with being able to easily twist the cap(s) on and off, as described herein.

It should also be noted that when inner 55, 65 and outer caps 51, 61 are attached to the housing 20 to enclose the corresponding compartments, the inner caps 55, 65 are recessed within the corresponding outer caps 51, 61 in a manner to create a compartment which may be used as a cup, can or bottle holder. For example, a user may desire to set his or her cup, can or bottle within the recessed area defined by the inner and outer caps, where the cup, can or bottle can be retained. With the ice compartment immediately below, in some cases, the recessed area may also at least partially transfer cooled temperatures to the cup, can, bottle or other drinking vessel while it is disposed within the recessed area or opening 53, 63.

Figure 11:
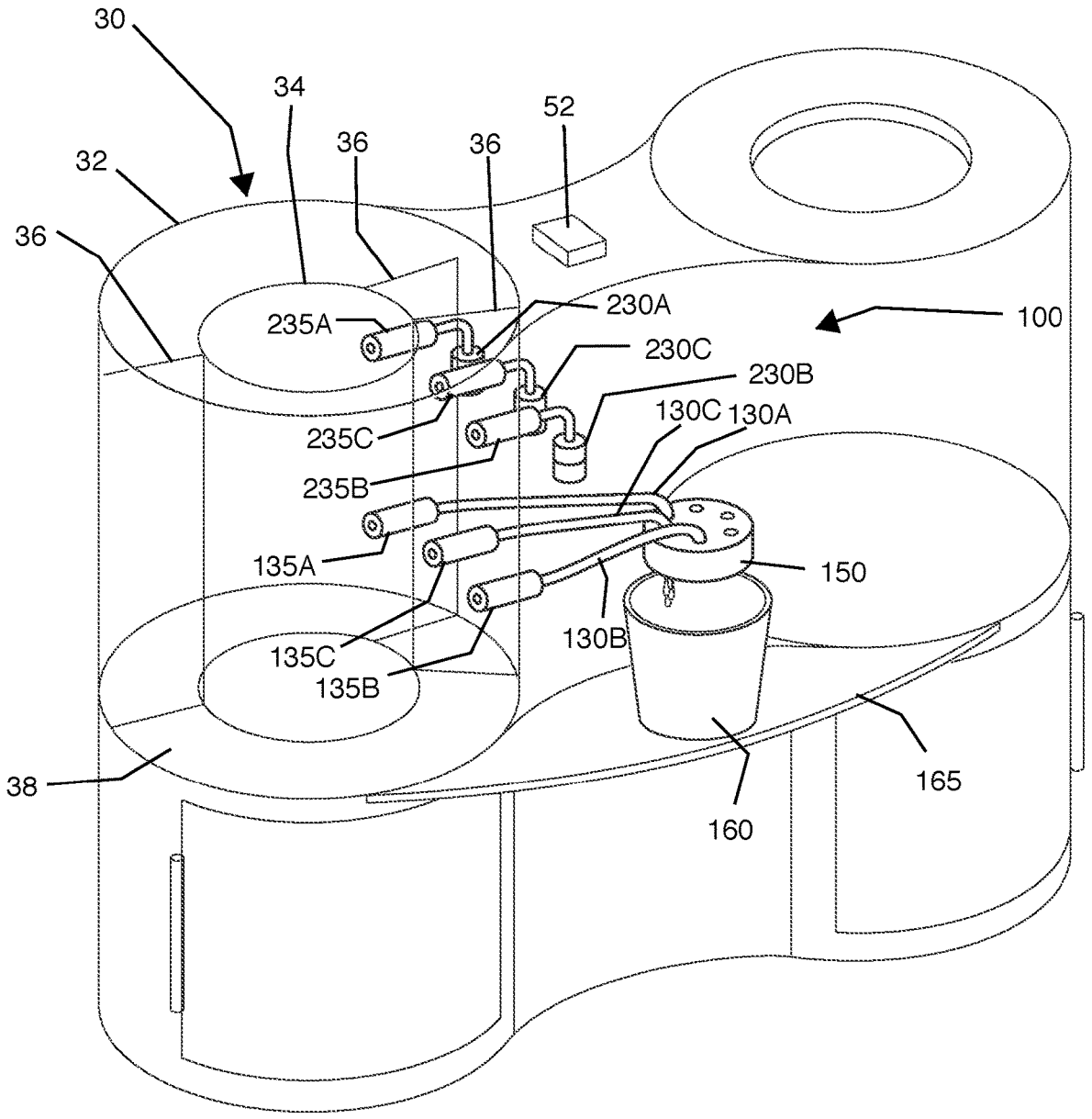
FIG. 11 is a partial interior view of the fluid dispensing assembly as disclosed in accordance with at least one embodiment of the present invention.

With reference now to FIGS. 11 through 14, the fluid discharge assembly 100 of at least one embodiment is illustrated. Specifically, the fluid discharge assembly 100 may include a plurality of fluid tubes 130A-C, 140A-C fluidically connected between a corresponding one of the fluid compartments 30A-C, 40A-C and at least one discharge nozzle 150. In other words, each of the separate fluid compartments 30A-C and 40A-C are fluidically connected to the nozzle 150 via a different one of the plurality of fluid tubes 130A-C and 140A-C. For instance, as shown in FIG. 11, tube 130A is fluidically interconnected between fluid compartment 30A and nozzle; tube 130B is fluidically interconnected between fluid compartment 30B and nozzle 150; and tube 130C is fluidically interconnected between fluid compartment 30C and nozzle 150. Similarly, with reference to FIG. 12, tube 140A is fluidically interconnected between fluid compartment 40A and nozzle 150; tube 140B is fluidically interconnected between fluid compartment 40B and nozzle 150; and tube 140C is fluidically interconnected between fluid compartment 40C and nozzle 150.

Figure 12:
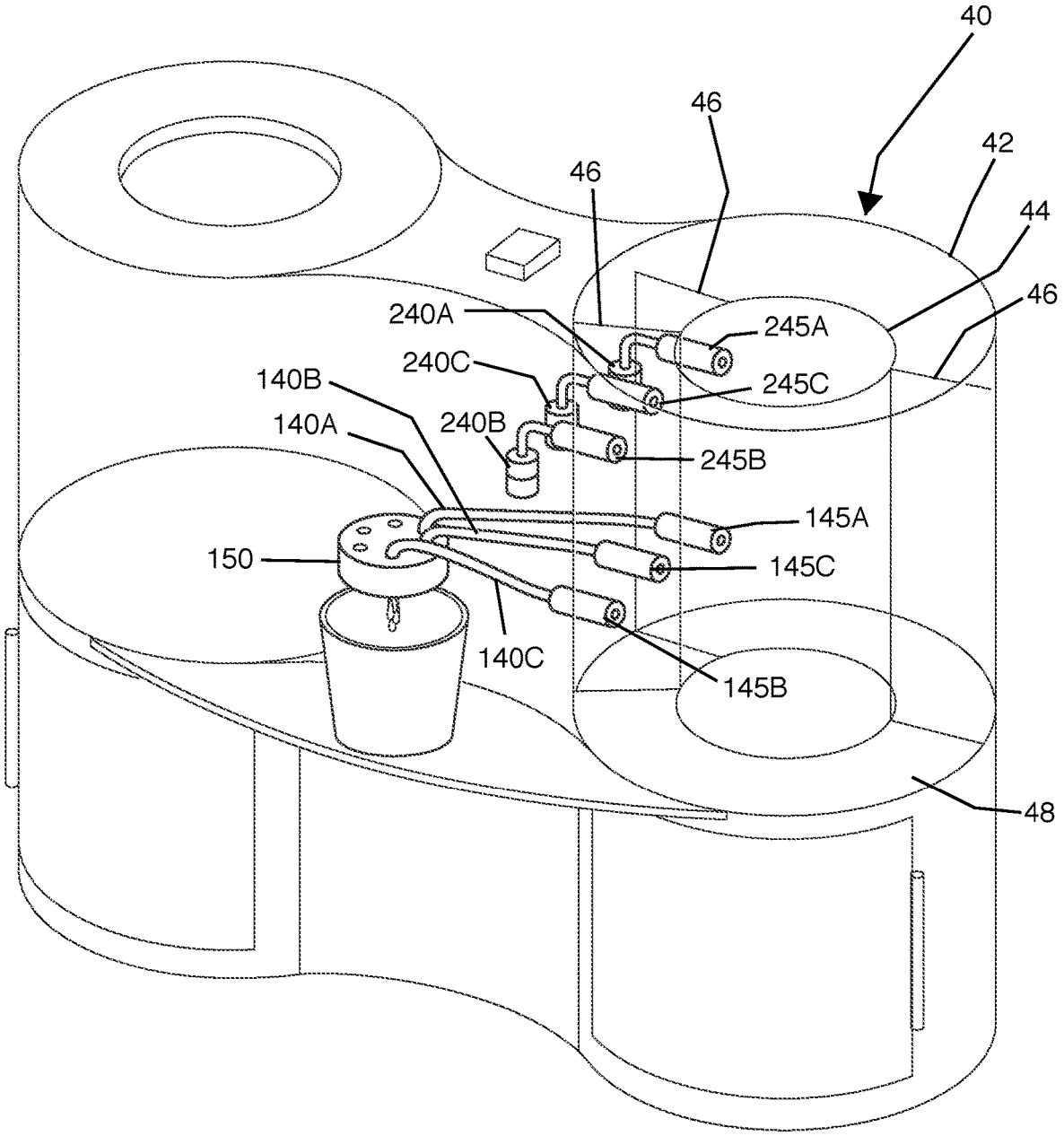
FIG. 12 is another partial interior view of the fluid dispensing assembly as disclosed in accordance with at least one embodiment herein.
Figure 14:
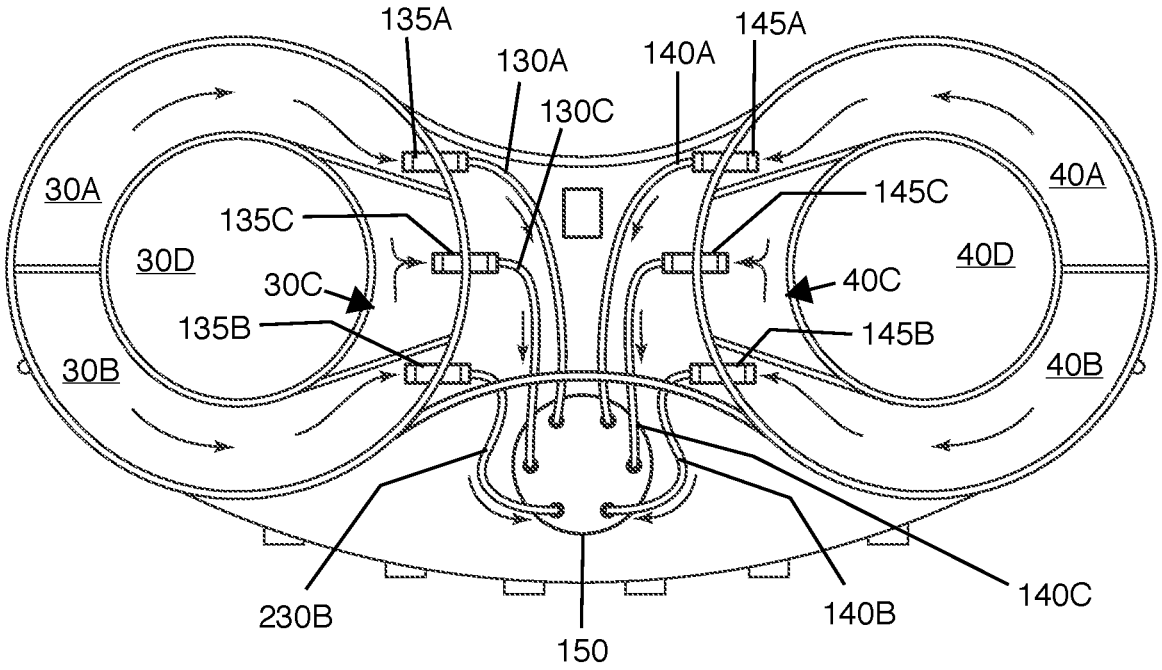
FIG. 14 is another top interior view illustrating a portion of the fluid dispensing assembly as disclosed in accordance with at least one embodiment herein.

In addition, connectors 135A, 135B and 135C may be used to interconnect the tubes 130A-C to corresponding fluid compartments 30A-C, and connectors 145A, 145B, 145C may be used to interconnect the tubes 140A-C with corresponding fluid compartments 40A-C. Connectors 135A-C and 145A-C may in some embodiments, include valves when can be opened and closed via a controller assembly (not shown) in order to control the flow of fluid therethrough. Furthermore, as shown in FIGS. 11, 12 and 14, the connectors and/or tubes of at least one embodiment, pass through the shared wall between the component enclosure 54 and the fluid compartment 30A-C, 40A-C. In this manner, each of the fluid compartments 30A-C and 40A-C of at least one embodiment include a portion that is directly adjacent the component enclosure 54, or otherwise the fluid compartments of at least one embodiment may share a portion of a common wall with the component enclosure 54. This allows at least some of the components, such as all of the fluid tubes to reside in the central component enclosure 54 with direct access to each of the plurality of fluid compartments.

The top view of FIG. 14 illustrates the interconnection of the separate tubes 130A-C and 140A-C between each of the different fluid compartments 30A-C, 40A-C and the nozzle 150. For simplicity of illustration, the plurality of pumps are excluded from FIG. 14.

For instance, with reference to FIGS. 11 and 12, the fluid discharge assembly 100 of at least one embodiment further includes a plurality of pumps referenced as 230A, 230B, 230C and 240A, 240B, 240C each interconnected to a different one of the plurality of fluid compartments 30A-C, 40A-C. In other words, each of the separate fluid compartments 30A-C and 40A-C are interconnected to a different one of the plurality of pumps 230A-C, 240A-C. It is contemplated, however, that a single pump (or fewer pumps than fluid compartments) can be used in accordance with at least one embodiment. In that case, the one or more pumps may be interconnected to more than on fluid chamber and controlled, for example, via valves (not shown), to direct air, CO2 or other gas into a desired fluid compartment, as described herein.

Figure 13:
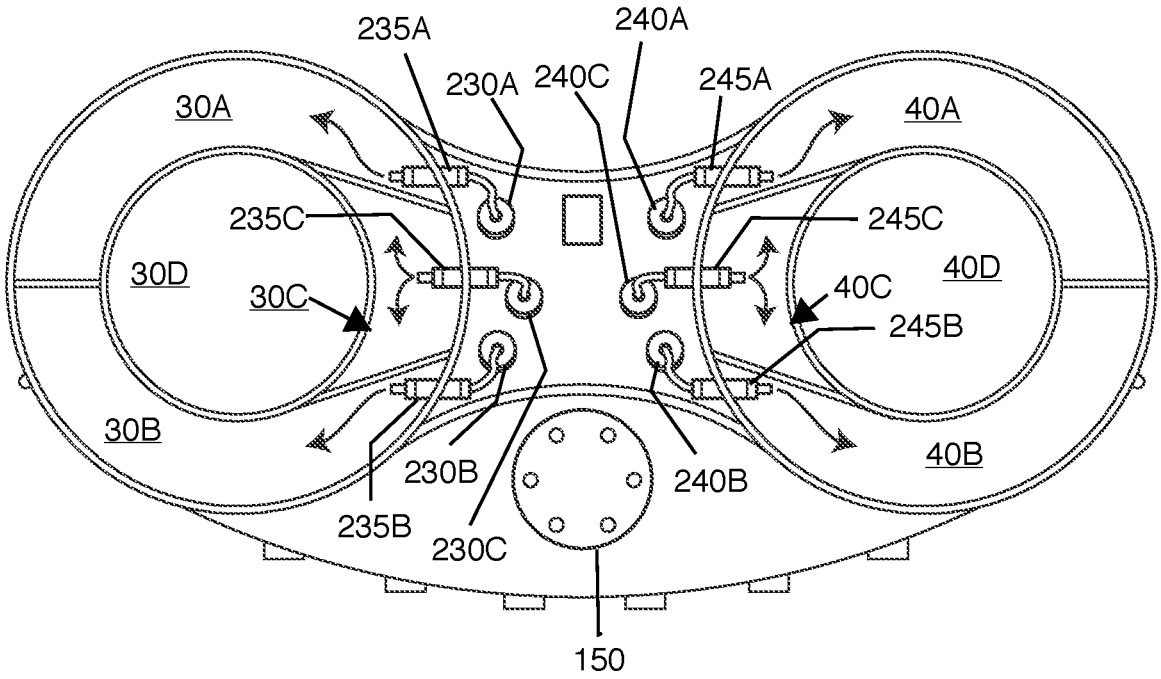
FIG. 13 is a top interior view illustrating a portion of the fluid dispensing assembly as disclosed in accordance with at least one embodiment herein.

The top view of FIG. 13 illustrates the interconnection of the separate pumps 230A-C and 240A-C with each of the different fluid compartments 30A-C, 40A-C For simplicity of illustration, the plurality of fluid tubes are excluded from FIG. 13.

In any event, the one or more pumps 230A-C, 240A-C are interconnected to the plurality of fluid compartments 30A-C, 40A-C via a plurality of connectors 235A-C, 245A-C which, in at least one embodiment, pass through the shared wall between the component enclosure 54 and the fluid compartment 30A-C, 40A-C.

As an example, the pumps 230A-C, 240A-C may include air pumps which serve each of the different fluid compartments in an individual manner. In one exemplary embodiment, the air pumps 230A-C, 240A-C may each have a three to six volt capacity supported by or driven by the rechargeable battery 52, which may be capable of providing at least eight hours of operation at full capacity. Furthermore, the fluid tubes 130A-C, 140A-C of at least one exemplary embodiment may be a 5/16 inch hose whereas the air hoses or tubes may be 3/16 inch hoses, although other sizes are contemplated.

In this manner, when a user presses or selects one of the activators 12 a controller will activate a corresponding one of the plurality of air pumps 230A-C, 240A-C (e.g., the air pump that correspond with the fluid compartment associated with the user's selection) to pump an amount of air (or other gas) into the corresponding fluid compartment. If necessary, a valve will be opened, and fluid will flow out of the fluid compartment through the corresponding fluid tube, to the nozzle 150 and into the cup or other vessel 160. In other words, air or other gas pumped into the fluid compartment will pressurize the fluid compartment forcing the fluid therein to flow through the corresponding tube and out of the nozzle 150. Since the pumps of at least one embodiment are air pumps, the present invention is operable without the need for additional CO2 canisters or sources. Although in other embodiments, the pump(s) may function to pump or distribute compressed gases such as CO2 into the compartments.

Still referring to FIGS. 11 through 14, the nozzle 150 of at least one embodiment may include a plurality of connections or locations in which each of the plurality of fluid tubes 130A-C, 140A-C can fluidically connect. In other words, a single nozzle 150 may be used which can fluidically interconnected to each of the different fluid tube 130A-C, 140A-C. The nozzle 150 may, in some embodiments, rotate in a clockwise and/or counterclockwise direction (e.g., along the horizontal plane) depending on which one of the fluid tubes is dispensing fluid. In other embodiments, the nozzle 150 may remain stationary. As shown, a platform 165 is disposed directly beneath the nozzle 150 upon which the user's cup or other vessel 160 can rest while the assembly 10 of the present invention dispenses fluid therein.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A beverage dispenser, comprising:

a housing, said housing comprising a first chamber and a second chamber separated by a component enclosure, said first chamber comprising an inner ice compartment surrounded by a plurality of partitioned fluid compartments, said second chamber comprising an inner ice compartment surrounded by a plurality of partitioned fluid compartments, each of said plurality of partitioned fluid compartments of said first chamber and each of said plurality of partitioned fluid compartments of said second chamber being fluidically interconnected to at least one discharge nozzle via a fluid discharge assembly, said housing further comprising a first storage compartment disposed below said first chamber and a second storage compartment disposed below said second chamber.

2. The beverage dispenser as recited in claim 1 wherein each of said plurality of partitioned fluid compartments of said first chamber comprise a portion directly adjacent to said inner ice compartment of said first chamber, and wherein each of said plurality of partitioned fluid compartments of said second chamber comprise a portion directly adjacent to said inner ice compartment of said second chamber.

3. The beverage dispenser as recited in claim 2 wherein each of said plurality of partitioned fluid compartments of said first chamber share at least a portion of a common wall with said inner ice compartment of said first chamber, and wherein each of said plurality of partitioned fluid compartments of said second chamber share at least a portion of a common wall with said inner ice compartment of said second chamber.

4. The beverage dispenser as recited in claim 2 wherein each of said plurality of partitioned fluid compartments of said first chamber comprise a portion directly adjacent to said component enclosure, and wherein each of said plurality of partitioned fluid compartments of said second chamber comprise a portion directly adjacent to said component enclosure.

5. The beverage dispenser as recited in claim 4 wherein each of said plurality of partitioned fluid compartments of said first chamber share at least a portion of a common wall with said component enclosure, and wherein each of said plurality of partitioned fluid compartments of said second chamber share at least a portion of a common wall with said component enclosure.

6. The beverage dispenser as recited in claim 5 wherein each of said plurality of partitioned fluid compartments of said first chamber share at least a portion of a common wall with said inner ice compartment of said first chamber, and wherein each of said plurality of partitioned fluid compartments of said second chamber share at least a portion of a common wall with said inner ice compartment of said second chamber.

7. The beverage dispenser as recited in claim 6 wherein said fluid discharge assembly comprises a plurality of fluid tubes, wherein each of said plurality of fluid compartments of said first chamber and each of said plurality of fluid compartments of said second chamber are separately fluidically interconnected to said at least one discharge nozzle via a different one of said plurality of fluid tubes.

8. The beverage dispenser as recited in claim 7 wherein said fluid discharge assembly further comprises at least one air pump, wherein each of said plurality of fluid compartments of said first chamber and each of said plurality of fluid compartments of said second chamber are communicatively interconnected with said at least one air pump.

9. The beverage dispenser as recited in claim 8 wherein said at least one air pump comprises a plurality of air pumps, wherein each of said plurality of fluid compartments of said first chamber and each of said plurality of fluid compartments of said second chamber are communicatively interconnected to a different one of said plurality of air pumps.

10. The beverage dispenser as recited in claim 1 wherein said fluid discharge assembly comprises a plurality activators each corresponding to a different one of said plurality of fluid compartments of said first chamber and said second chamber.

11. The beverage dispenser as recited in claim 10 wherein activation of one of the plurality activators controls a discharge of an amount of fluid disposed within a corresponding one of said plurality of fluid compartments of said first chamber and said second chamber.

12. The beverage dispenser as recited in claim 1 wherein said first chamber comprises a cylindrical outer wall and a concentrically disposed cylindrical inner wall, wherein said concentrically disposed cylindrical inner wall of said first chamber at least partially defines said inner ice compartment of said first chamber, and wherein said second chamber comprises a cylindrical outer wall and a concentrically disposed inner wall, wherein said concentrically disposed cylindrical inner wall of said second chamber at least partially defines said inner ice compartment of said second chamber.

13. The beverage dispenser as recited in claim 12 wherein said first chamber comprises a plurality of inner partition walls sealed between said cylindrical outer wall and said concentrically disposed inner wall of said first chamber, said plurality of inner partition walls of said first chamber at least partially defining said plurality of fluid compartments of said first chamber, and wherein said second chamber comprises a plurality of inner partition walls sealed between said cylindrical outer wall and said concentrically disposed inner wall of said second chamber, said plurality of inner partition walls of said second chamber at least partially defining said plurality of fluid compartments of said second chamber.

14. The beverage dispenser as recited in claim 13 further comprising a first cap assembly configured to selectively enclose said first chamber and a second cap assembly configured to selectively enclose said second chamber.

15. The beverage dispenser as recited in claim 14 wherein said first cap assembly comprises an outer cap and an inner cap, said outer cap of said first cap assembly being configured to enclose said plurality of fluid compartments of said first chamber, and said inner cap of said first cap assembly being configured to enclose said inner ice compartment of said first chamber, and wherein said second cap assembly comprises an outer cap and an inner cap, said outer cap of said second cap assembly being configured to enclose said plurality of fluid compartments of said second chamber, and said inner cap of said second cap assembly being configured to enclose said inner ice compartment of said second chamber.

16. The beverage dispenser as recited in claim 15 wherein when said outer cap and said inner cap of said first cap assembly encloses said first chamber, said inner cap of said first cap assembly is recessed within said outer cap of said first cap assembly defining a first cup holder, and wherein when said outer cap and said inner cap of said second cap assembly encloses said second chamber, said inner cap of said second cap assembly is recessed within said outer cap of said second cap assembly defining a second cup holder.

17. A beverage dispenser, comprising:

a housing, said housing comprising a plurality of fluid compartments fluidically interconnected to at least one discharge nozzle via a fluid discharge assembly, said housing comprising a first chamber and a second chamber, said first chamber defining a first set of said plurality of fluid compartments, and said second chamber defining a second set of said plurality of fluid compartments, wherein said first chamber comprises an inner ice compartment surrounded by said first set of said plurality of fluid compartments and wherein said second chamber comprises an inner ice compartment surrounded by said second set of said plurality of fluid compartments, said fluid discharge assembly comprising a plurality of air pumps and a plurality of fluid discharge tubes, wherein each of said plurality of fluid compartments are connected to a different one of said plurality of air pumps and wherein each of said plurality of fluid compartments are fluidically interconnected to said at least one discharge nozzle via a different one of said plurality of fluid discharge tubes, said fluid discharge assembly further comprises a plurality of activators, each of said plurality of activators being associated with a different one of said plurality of fluid compartments, wherein selective activation of one of said plurality of activators activates a corresponding one of said plurality of air pumps and discharges fluid through a corresponding one of said fluid discharge tubes from a corresponding one of said plurality of fluid compartments.

18. The beverage dispenser as recited in claim 17 wherein said housing further comprises a first storage compartment disposed below said first chamber and a second compartment disposed below said second chamber.

* * * * *